US005740773A

United States Patent [19]

Ohshige

[11] Patent Number: 5,740,773

[45] Date of Patent: Apr. 21, 1998

[54] V-TYPE ENGINE

[75] Inventor: Hidetoshi Ohshige, Hamamatsu, Japan

[73] Assignee: Suzuki Kabushiki Kaisha, Japan

[21] Appl. No.: 721,350

[22] Filed: Sep. 26, 1996

[30] Foreign Application Priority Data

Mar. 26, 1996 [JP] Japan ..... 8-069770

[51] Int. Cl.[6] ..... F01L 1/00; F02B 77/00

[52] U.S. Cl. ..... 123/198 DA; 384/295

[58] Field of Search ..... 123/54.4, 198 DA, 123/195 R; 384/294, 295

[56] References Cited

U.S. PATENT DOCUMENTS

| | | | |
|---|---|---|---|
| 1,916,292 | 7/1933 | Woolson | 123/54.4 |
| 2,334,916 | 11/1943 | Ford et al. | 123/54.4 |
| 3,046,953 | 7/1962 | Dolza | 384/294 |
| 3,069,926 | 12/1962 | Hoffman et al. | 384/294 |
| 3,249,391 | 5/1966 | De Hart et al. | 384/294 |
| 4,073,550 | 2/1978 | Yahraus | 384/294 |
| 4,470,379 | 9/1984 | Miyakoshi et al. | 123/DIG. 8 |
| 4,534,322 | 8/1985 | Matsuda et al. | 123/54.4 |
| 4,845,817 | 7/1989 | Wilgus | 384/294 |
| 5,062,718 | 11/1991 | Lenhard-Backhaus et al. | 384/294 |
| 5,192,136 | 3/1993 | Thompson et al. | 384/294 |
| 5,579,731 | 12/1996 | Pong | 123/DIG. 8 |

FOREIGN PATENT DOCUMENTS

| | | |
|---|---|---|
| 63-23020 | 1/1988 | Japan . |
| 64-83912 | 3/1989 | Japan . |

*Primary Examiner*—David A. Okonsky
*Attorney, Agent, or Firm*—Ronald P. Kananen

[57] ABSTRACT

In a V-type engine having a crankcase dividable into two halves in side ways, a crankshaft disposed inside the crankcase, a plurality of cylinder assemblies disposed onto the crankcase, arranged in V-shape and parallel to the divided faces of the crankcase, and pairs of metal bearing halves which support the crankshaft, wherein the metal bearing halves are press fit into predetermined positions inside the crankcase halves, and the metal bearing halves are arranged so that matching faces of the bearing halves make a right angle with a line which divide an angle between the V-shaped cylinder assemblies in half.

8 Claims, 4 Drawing Sheets

V-TYPE ENGINE

BACKGROUND OF THE INVENTION

The present invention relates to a bearing arrangement for a crankshaft of a V-type engine. More particularly, the present invention relates to a bearing arrangement for an engine crankcase which is laterally or "sideways" dividable into two halves.

An engine having a crankcase which is dividable sideways into left and right halves (viz., is dividable along a plane or interface which is normal to the crank axis), and which conventionally uses ball bearings for supporting a crankshaft, is disclosed in Japanese Patent Publication (laid-open) No. 83,912/1989.

Further, an engine which has a crankcase dividable into upper and lower halves (viz., is separable along a plane which is essentially parallel to the crank axis) and which conventionally uses pairs of metal bearing halves for supporting crankshaft, is disclosed in Japanese Patent Publication laid-open) No. 23,020/1988.

Moreover, there are engines having crankcases dividable sideways into two halves which use roller bearing and/or bushings for supporting crankshafts. However, ball bearings and roller bearings used for supporting crankshafts are less advantageous with respect to high loads as compared to metal bearing halves, and are higher in costs compared with metal bearings.

Further, if bushings are used for supporting crankshafts, these bushings need some processing after being installed in the crankcases, and since they do not have overlays, they exhibit poor endurance with respect to loads. Therefore, they are generally not suitable for high rpm—high power output engines.

On the other hand, using metal bearing halves for supporting the crankshaft limits the crankcases to be divided only into upper and lower halves. Therefore, layouts of the crankshafts and other shafts become limited, which results the sizes of the engines being increased.

Japanese Patent Publication (laid-open) No. 292,411/1991, discloses an arrangement wherein metal bearing halves are firstly inserted into pairs of semicircular shaped housings, which are then subsequently installed in the housings of a crankcase which is divided sideways. However, this arrangement increases the number of parts and raises the cost of the engine.

SUMMARY OF THE INVENTION

An object of the present invention is to substantially eliminate defects or drawbacks encountered in the prior art described above and to provide bearings for the crankshaft in the V-type engine wherein the bearings comprise metal bearing halves, which are simple in structure, and which are disposed in a crankcase which is dividable sideways into two halves.

This and other objects can be achieved according to the present invention by providing a V-type engine comprising: a crankcase dividable sideways into two halves; a crankshaft disposed inside the crankcase; a plurality of cylinder assemblies disposed onto the crankcase, arranged in V-shape and parallel to the divided faces of the crankcase; and pairs of metal bearing halves which support the crankshaft, wherein the metal bearing halves are installed into predetermined positions inside the crankcase halves, and the metal bearing halves are arranged so that matching faces of the bearing halves make a right angle with a line which divide an angle between the V-shaped cylinder assemblies in half.

In preferred embodiments, the metal bearing halves are press fitted into the crankcase.

According to the V-type engine of the present invention of the characters described above, the loads which the matching faces of the bearing halves receive become equal.

Therefore, metal bearing halves, which are more advantageous against high loads rather than ball bearings and roller bearings, can be used in the crankcase which is dividable into two halves in sideways.

Further, metal bearing halves are less expensive in costs compared with ball bearings and roller bearings.

Furthermore, metal bearing halves have overlays, therefore metal bearing halves are suitable for engines with high rpm and high power output rather than bushings which do not have overlays.

Finally, by arranging the matching faces of the bearing halves so that the loads become equivalent or equal, the life of the metal bearings is extended.

The various features and advantages of the present invention will be made more clear hereunder through descriptions with reference to the accompanying drawings.

DESCRIPTION OF THE PREFERRED EMBODIMENT

One embodiment of the present invention will be described hereunder with reference to the accompanying drawings.

Figure 1:
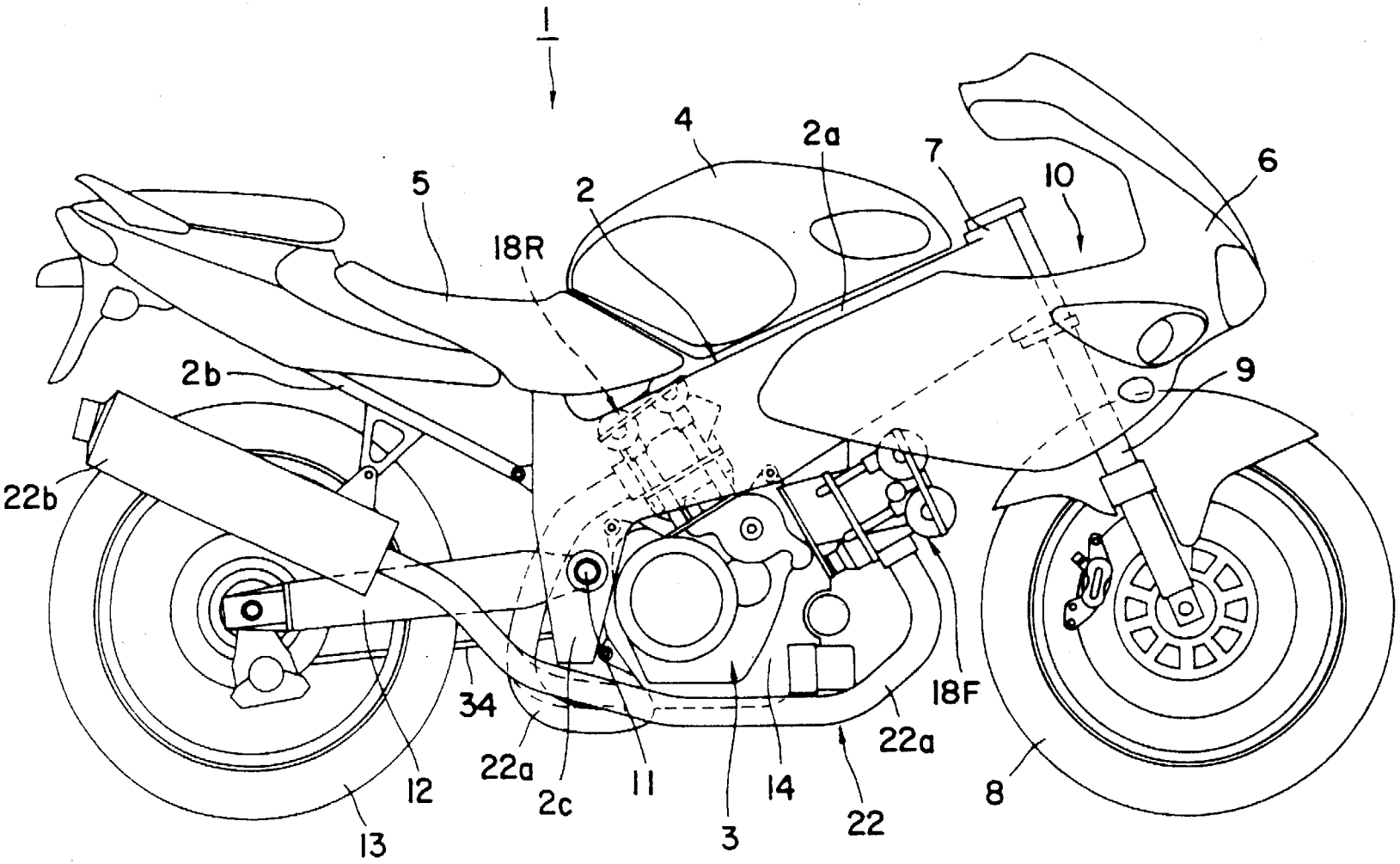
FIG. 1 is a side view showing a motorcycle to which the present invention is applicable.

FIG. 1 is a general right side view showing a motorcycle to which the present invention is applicable. Referring to FIG. 1, the motorcycle 1 has a body frame 2, and an engine 3 is mounted at a lower front portion of the body frame 2.

A fuel tank 4 is provided above the engine 3, and a seat 5 is positioned rearward of the fuel tank 4. The front portion of the motorcycle 1 is covered by a cowling 6, which is designed for reducing air resistance and protecting a rider from the wind pressure while the motorcycle 1 is moving.

A head pipe 7 is located at the front end of the body frame 1, and a steering mechanism 10, which comprises a pair of front forks 9 that supports a front wheel 8 rotatably, a handle bar (not shown) and the like, is rotatably mounted on the head pipe 7.

The body frame 2 is a twin-tube type frame, for example, that comprises a pair of main frames **2*a* which are widened right behind the head pipe 7 and extended rearward parallel to each other, and seat rails 2*b* which are extended rearward from near the central portion of the main frames 2*a*. Pivot sections 2*c* are provided at both sides of the lower rear portion of the main frames 2*a***.

A pivot shaft 11 is laid between the pivot sections **2*c*, and a front portion of a swing arm 12 is mounted swingably to the pivot shaft 11. A rear wheel 13 is supported rotatably at the end portion of the swing arm 12**.

Figure 2:
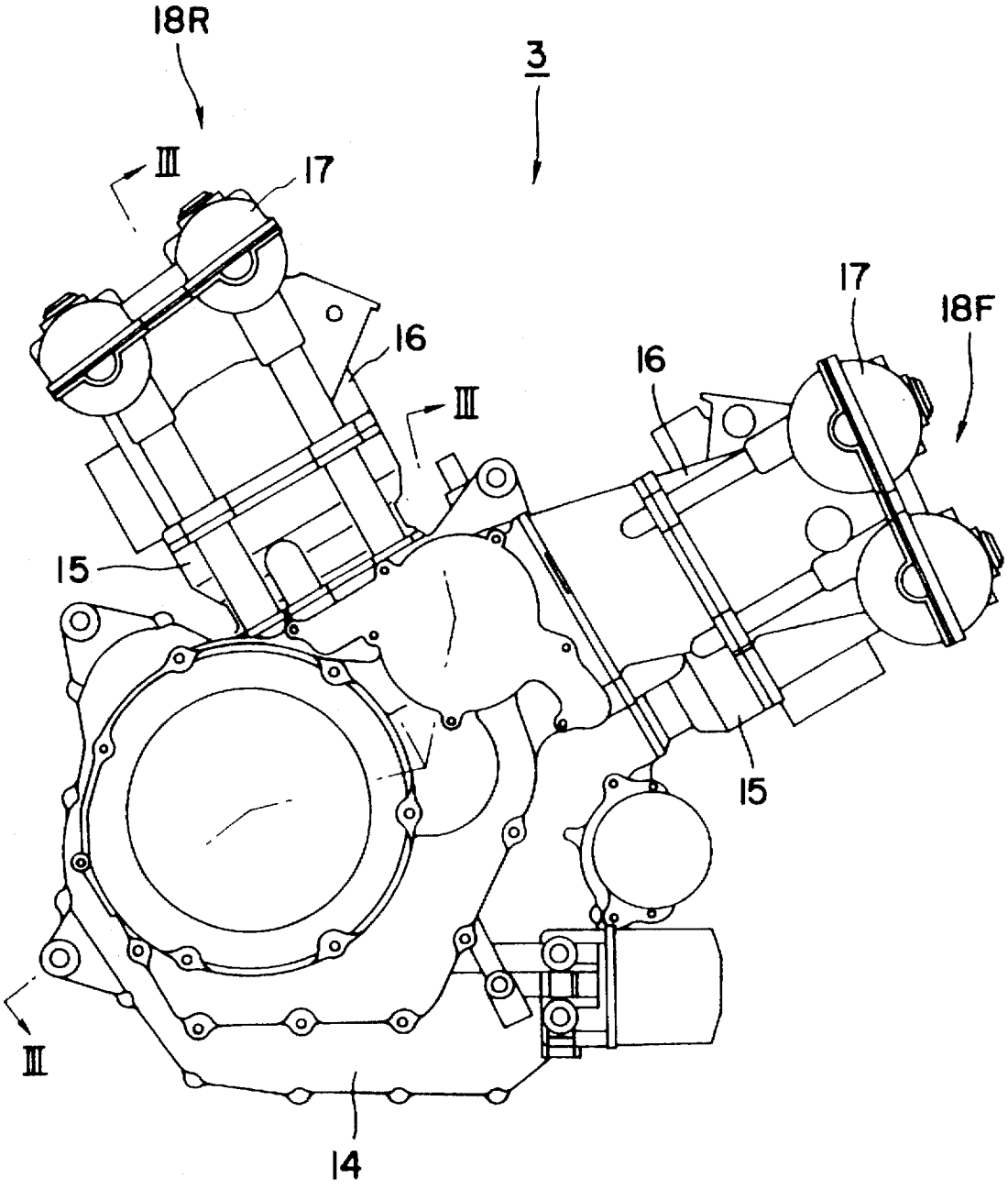
FIG. 2 is a right side view of an engine representing one embodiment of the present invention.
Figure 3:
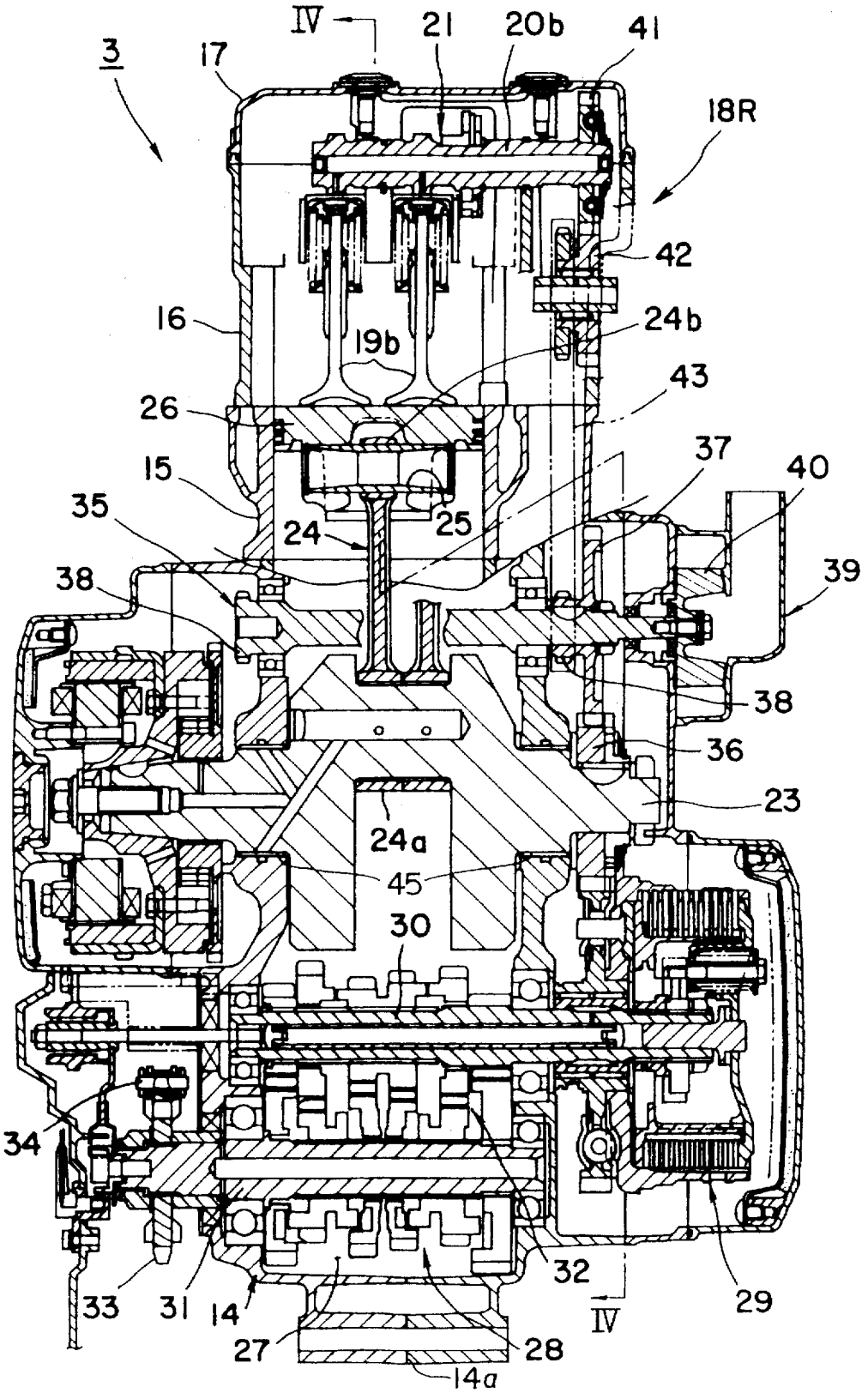
FIG. 3 is a sectional view taken along section line III—III of FIG. 2 showing a structure of the engine shown in FIG. 2.
Figure 4:
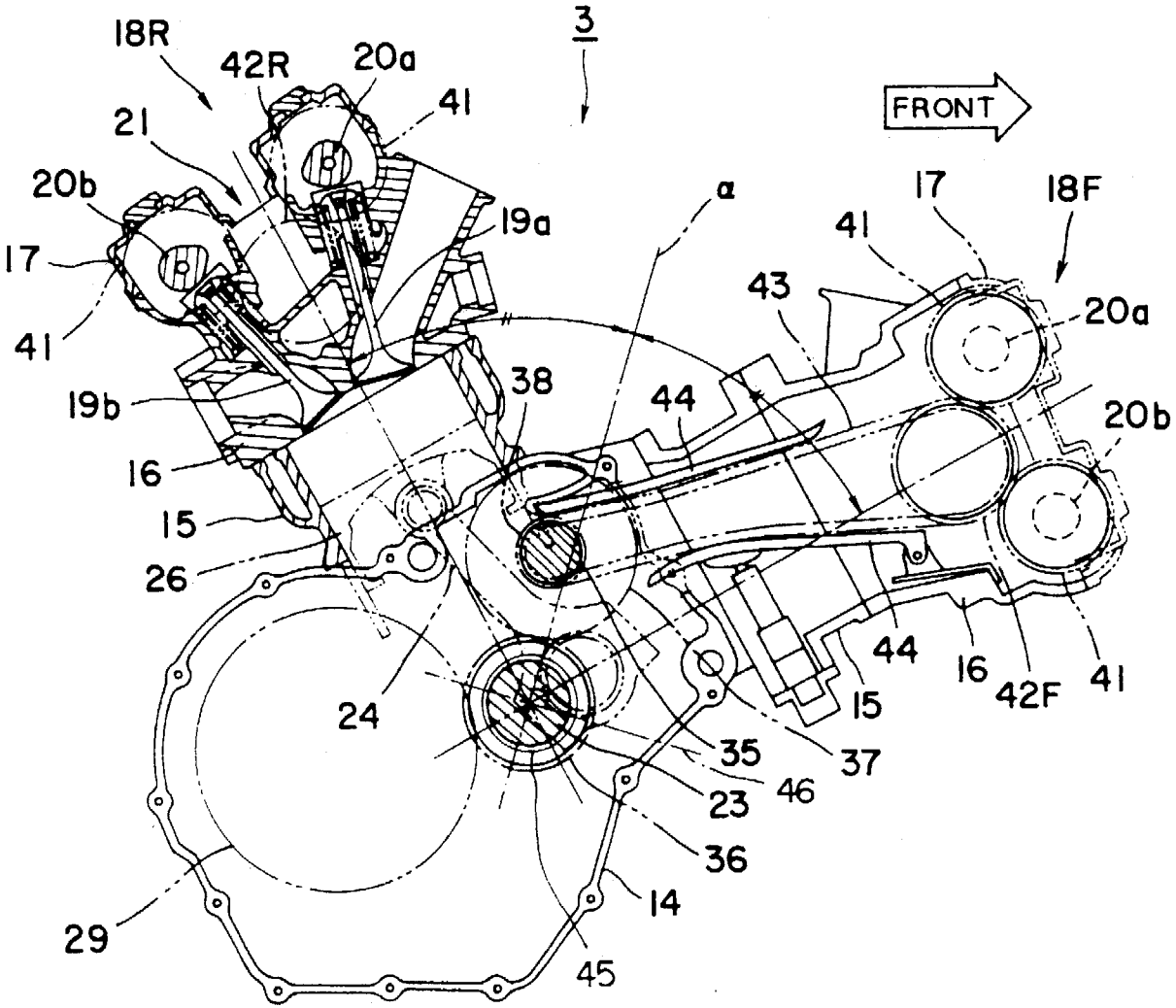
FIG. 4 is a sectional view taken along section line IV—IV of FIG. 3 showing the structure of the engine.

FIG. 2 is a right side view of the engine 3, while FIG. 3 is a sectional view taken along section line III—III of FIG. 2, and FIG. 4 is a sectional view taken along section line IV—IV of FIG. 3.

As shown in FIGS. 2 through 4, the engine 3 is formed its external form mainly by a crankcase 14, and a plurality of cylinder assemblies 18. Each of the cylinder assemblies comprises a cylinder block 15, a cylinder head 16, and a cylinder head cover 17.

The crankcase 14 of the engine 3 is dividable into two halves in side ways, right half and left half in this embodiment, and a plurality of cylinder assemblies, two cylinder assemblies 18F,18R in this embodiment, are located on top of the crankcase 14.

The engine 3 is a so called "V-Type Engine", i.e. the cylinder assemblies 18F,18R are arranged in V-shape and parallel to the divided faces 14*a* of the crankcase 14.

This engine 3 is a four-cycle engine, and has a double over head cam shaft (DOHC) type valve mechanism 21 which comprises two cam-shafts 20*a*,20*b* on top of the each cylinder head 16 for operating intake valves 19*a* and exhaust valves 19*b*.

An exhaust system 22 comprising exhaust pipes 22*a* and mufflers 22*b* are connected to the front of the front side cylinder assembly 18F and the rear of the rear side cylinder assembly 18R.

An air intake system comprising carburetors and an air cleaner (neither shown) are connected to the rear of the front side cylinder assembly 18F and the front of the rear side cylinder assembly 18R.

A crankshaft 23 is disposed in the crankcase 14 at a right angle to the direction of the vehicle movement. The crankshaft 23 is supported by pairs of metal bearing halves 45 which are press fitted into predetermined positions inside the both halves of the crankcase 14.

Furthermore, the metal bearing halves 45 are arranged so that matching faces 46 of the bearing halves 45 make a right angle with a line which divides an angle between the front side and rear side cylinder assemblies 18F,18R in half.

Although not show in detail, a groove is formed on the metal bearing half in its circumferential direction that is arranged in upper side of the pair. There is no groove formed on the metal bearing half that is arranged in lower side of the pair.

In the rear side cylinder assembly 18R, a large end 24*a* of a conrod 24 is connected to the crankshaft 23, and a small end 24*b* of the conrod is connected to a piston 26 through a piston pin 25. The piston 26 reciprocates in the cylinder block 15, then this reciprocation stroke is transmitted to the crankshaft 24 through the conrod 24 to make the crankshaft 23 revolves. The front side cylinder assembly 18F has the same mechanism as the rear side cylinder assembly 18R described above.

As shown in FIG. 3, a transmission mechanism 28, i.e. a primary speed reduction system, is disposed in a transmission room 27 formed in the rear portion of the crankcase 14. The transmission mechanism 28 comprises a counter-shaft 30 which is geared to the crankshaft 23, a clutch mechanism 29, and a drive-shaft 31 which transmits the driving force to the rear wheel 13 via a drive sprocket 33 and a drive chain 34.

There are a plurality of transmission gears 32 on the counter-shaft 30 and the drive-shaft 31. Each transmission gears 32 has different number of teeth, and the primary speed reduction is performed by changing the combinations of the transmission gears 32.

Further, one end of the drive-shaft 31 protrudes out side the transmission room 27, and the drive-sprocket 33 is mounted onto the end of the drive-shaft 31.

The drive-sprocket is operatively connected to a driven-sprocket (not shown) disposed on the rear wheel 13 by a drive-chain 34. The drive-chain 34 is a secondary speed reduction means which transmits the driving force from the engine 3 to the rear wheel 13.

An idler-shaft 35 is disposed above and parallel to the crankshaft 23. A cam-drive-sprocket 36 is disposed on the crankshaft 23, and a cam-driven-sprocket 37 is disposed on the idler-shaft 35. The cam-drive-sprocket 36 and the cam-driven-sprocket 37 are operatively engaged.

A pair of idler-drive-gears 38 are disposed on the idler-shaft 35. This idler-shaft 35 performs as a shaft of a coolant pump 39 at the same time, and an impeller 40 is mounted on an end portion of the idler-shaft 35.

On the other hand, cam-sprockets 41 are mounted on ends of each cam-shafts 20*a*,20*b* which are disposed parallel to the crankshaft 23 in the both cylinder heads 16. The cam-sprockets 41 are operatively engaged by idler-driven-gears 42F,42R.

Each idler-driven-gears 42F,42R are operatively engaged to the idler-drive-gears 38 on the idler-shaft 35 by cam-chains 43. Therefore, the valve mechanism 21 is operated by transmitting the revolution of the crankshaft 23 to the cam-shafts 20*a*,20*b* through the idler-shaft 35.

The tensions of the cam-chains 43 are maintained at appropriate levels by chain tensioners 44. The upper portions of the valve mechanisms 21 are covered by the cylinder head covers 17.

By arranging the metal bearing halves 45, which are installed inside the crankcase 14 and support the crankshaft 23, so that the matching faces 46 of the bearing halves 45 make a right angle (are normal) with the line (or plane) which divide the angle between the V-shaped cylinder assemblies 18F,18R in half, the loads which the matching faces 46 of the bearing halves 45 receive from both front and rear pistons 26 become equal.

Therefore, metal bearing halves, which are more advantageous against high loads rather than ball bearings and roller bearings, can be used in the crankcase which is dividable sideways into left and right halves.

It is to be noted that the present invention is not limited to the described embodiment and many other modifications and changes may be made without departing from the scope of the appended claims.

What is claimed is:

1. A V-type engine comprising:

a crankshaft which is rotatable about an axis;

a crankcase in which said crankshaft is rotatably supported, said crankcase being formed in two halves which are connected along a plane which normally intersects the axis of rotation of said crankshaft;

a plurality of cylinders which are arranged in a V-shaped cylinder assembly so that the axes of the cylinders are parallel to the plane along which the two halves of the crankcase are connected; and first and second bearings which are each respectively formed in upper and lower halves and which are press fitted into first and second supporting portions of said crankcase, the upper and lower halves of said first and second bearings being arranged to face each other along a plane which is essentially normal to a line which divides an angle between the V-shaped cylinder assembly in half.

2. A V-type engine according to claim 1, wherein said first and second bearings are arranged so that the upper half of each pair of bearings is formed with a groove which extends along its circumference, and wherein the lower half of each pair of bearings is free of grooves.

3. A V-type engine according to claim 1, wherein said engine is a 4 cycle engine having a dual overhead cam with two cam shafts on top of each said cylinder.

4. A V-type engine according to claim 1, wherein each said cylinder has an exhaust system connected thereto.

5. A V-type engine according to claim 1, further comprising a transmission mechanism disposed in said crankcase and comprising a counter-shaft which is geared to said crankshaft through a clutch mechanism.

6. A V-type engine according to claim 1, wherein said metal bearing halves are press fitted into the crankcase.

7. An engine comprising:

a pair of cylinders arranged at a predetermined acute angle with respect to each other;

a crankshaft;

a crankcase which encloses said crankshaft and which is formed in two halves which separate along an interface which lies on a plane which normally intersect an axis of rotation of said crankshaft; and a pair of bearings supported in said crankcase for rotatably supporting said crankshaft, said pair of bearings each being formed of two halves which face each other along a plane which is normal to a line which bisects the acute angle at which said pair of cylinders are arranged, and in a manner which equalizes the load which is applied to each half.

8. A method of assembling a V-type engine comprising:

mounting a crankshaft in a crankcase and supporting said crankshaft with a plurality of bearings, said crankcase being divided into two halves along a plane normal to a rotational axis of said crankshaft;

wherein each of said plurality of bearings comprises upper and lower halves, the halves being press fitted into the crankcase prior to said mounting of said crankshaft.

* * * * *